US005552673A

United States Patent [19]

Kenwood

[11] Patent Number: 5,552,673

[45] Date of Patent: Sep. 3, 1996

[54] THEFT RESISTANT COMPACT FLUORESCENT LIGHTING SYSTEM

[76] Inventor: Michael Kenwood, 282 Oakland Ave., Miller Place, N.Y. 11764

[21] Appl. No.: 317,380

[22] Filed: Oct. 4, 1994

[51] Int. Cl.[6] ..... H01J 7/44

[52] U.S. Cl. ..... 315/57; 315/58; 315/70; 313/51; 313/318.01

[58] Field of Search ..... 315/58, 71, 57, 315/70, 212; 439/235, 236, 242, 660; 362/221; 313/51, 577, 318

[56] References Cited

U.S. PATENT DOCUMENTS

| | | | |
|---|---|---|---|
| 2,020,786 | 11/1935 | Klinkhamer et al. | 176/124 |
| 3,302,030 | 1/1967 | Deming | 307/17 |
| 4,323,823 | 4/1982 | Boggavarapu | 315/254 |
| 4,348,612 | 9/1982 | Morton | 315/58 |
| 4,441,055 | 4/1984 | Balchjunas et al. | 315/288 |
| 4,723,200 | 2/1988 | Troen | 315/57 |
| 4,746,840 | 5/1988 | Lim | 315/58 |
| 4,802,073 | 1/1989 | Plumly | 362/251 |
| 4,947,086 | 8/1990 | Nagano | 315/251 |
| 5,021,706 | 6/1991 | Chen | 313/318.01 |
| 5,150,008 | 9/1992 | Lee | 313/318.12 |
| 5,202,607 | 4/1993 | Broyer et al. | 315/58 |

*Primary Examiner*—Frank Gonzalez
*Assistant Examiner*—Reginald A Ratliff
*Attorney, Agent, or Firm*—William M. Nugent

[57] ABSTRACT

A fluorescent lighting system is disclosed which provides for selective lighting of several fluorescent lamps of differing power ratings so as to provide several stages of fluorescent illumination. The ballast transformers of the fluorescent lighting system are supported in at least one ballast transformer support case which is maintained in a spaced apart relationship to at least one fluorescent lamp support case.

26 Claims, 10 Drawing Sheets

THEFT RESISTANT COMPACT FLUORESCENT LIGHTING SYSTEM

BACKGROUND OF THE INVENTION

The present invention relates generally to lighting systems, and more specifically to compact modular fluorescent light systems constructed to provide power to at least one and preferably a plurality of fluorescent lamps which can be energized individually or in selected combinations.

Fluorescent lamps are well known to be much more efficient in producing light output for any given electrical energy input, compared to incandescent lamps. Thus, a fluorescent lamp will consume far less electrical energy than will an incandescent lamp when each provides the same amount of illumination. The cost of providing light, therefore, is significantly less when fluorescent lamps are used rather than incandescent lamps. The cost savings of using the fluorescent lamps is particularly important in situations requiring the use of many lamps for extended periods of illumination, such as found in industrial plants and hotels and motels. In addition to consuming less electrical energy per unit light output than incandescent lamps, the fluorescent lamps have longer lifespans than the incandescent lamps, thereby reducing the frequency of replacement, consequently reducing labor and material costs over the term of use of the lamps.

The significance of the ecological, as wall as the economic, advantages of fluorescent lamps over incandescent lamps is recognized by electrical power and local government authorities, which often provide tax or other incentives to those who use fluorescent lamps. For example, the Long Island Lighting Company encourages the installation of energy saving technologies though its 1994 Energy Wise Program. That program provides, among other incentives, rebates for installation of fluorescent lighting to replace incandescent lighting. Typical rebates at the present time are $0.35 per incandescent lamp and $10–$40 per fluorescent lighting fixtures which permanently replace incandescent fixtures. Such rebates can be very important economic incentives which result in ecological benefits as well, particularly in high volume usage of lighting, as in hotels and in industrial installations.

It is important to understand, however, that such rebates normally are not available for light fixtures which enable the use of fluorescent lamps but which also enable the replacement of fluorescent lamps by incandescent lamps. The power companies typically do not approve rebates until they have inspected the applying facility to confirm that the fluorescent fittings are permanent.

Recognition of the advantages of fluorescent lighting is well established. However, the lighting industry has been confronted with some problems which limit the uses of fluorescent lighting. For example, in new installations it is easy to plan for fluorescent lighting fixtures as part of the overall construction, but in established sites, the need to retrofit for fluorescent lighting is not as simple. Where it has not been economically or physically practicable to remove existing incandescent fixtures and install new fluorescent fixtures, the advantages of the latter might never be realized.

Efforts have been made to find ways to use existing lighting fixtures designed for using incandescent lamps and adapt them to the use of fluorescent lamps. Such efforts to date have resulted in devices such as that disclosed in U.S. Pat. No. 4,348,612 to Morton, which is a self-contained fluorescent light adapter which includes a fluorescent lamp, a lamp socket, a ballast transformer, capacitors, a lamp cover and a screw base for attaching to incandescent light fixtures. Another attempt to adapt fluorescent lamps for use in incandescent light fixtures is shown by U.S. Pat. No. 5,202,607 to Broyer et al. That device provides two fluorescent lamps combined into a single self-contained adapter whose case also includes lamp sockets, two ballast transformers and a base that screws into typical incandescent lighting fixtures to make electrical connection to power supplies. Those adapters, because they are assembled as single units, are designed to be installed and removed easily from incandescent fixtures with no more effort or knowledge than that required to install or remove incandescent lamps. And they are designed to enable anyone to insert them into incandescent light fixtures without the need for additional parts or equipment, such as ballast transformers, as they are contained in a single adapter case.

Although such adapters have made some limited progress in expanding the use of fluorescent lighting in residential use, in practice they have some very significant disadvantages that make them undesirable, especially for use in hotel, motel, commercial and industrial applications. For example, the adapters are expensive to make and expensive to replace, as they include the fluorescent lamps and ballast transformers and related structures as a single, self-contained unit. Replacing such a comprehensive lighting unit is many times more expensive than replacing a fluorescent or incandescent lamp. Thus, even if the high volume user is economically able to purchase the adapters initially, the replacement costs are far higher than the replacement costs for incandescent lamps.

One of the most disadvantageous characteristics of such adapters is the fact (originally asserted to be an advantage) that they are specifically designed to be easily installable and replaceable. While this might be advantageous to the residential user who can control access to the expensive adapters, hotels and other high volume lighting users consider it to be a critical disadvantage considered in their decisions not to use them. This is because the ease with which the adapters are removed, and the fact that the adapters are exposed to very large numbers of people, such as those renting hotel rooms, make the adapters susceptible to easy theft. The advantages of fluorescent lighting is so well known today, that people are easily tempted to remove the adapters from hotels and the like, especially as it is clear that the adapters can be used without any alteration in existing incandescent light fixtures and with no knowledge in addition to that needed to install an incandescent lamp.

The result has been so disastrous for hotels and other high volume users of lighting systems that the initial eagerness to install the adapters has been replaced by a frustration with the theft problem and its resulting high costs. Thus, high volume lighting users have been forced either to continue incandescent use or absorb the exorbitant and unacceptable costs of purchasing replacement adapters long before the end of the useful life of the adapters And the ready replacement of such adapters by incandescent lamps is an attractive response to theft or breakage. The advantages hoped for fluorescent installations using the adapters such as those disclosed by Morton or by Broyer et al. thus are actually unavailable, especially to such high volume lighting users.

One of the clearest indicators of the disadvantages of self-contained fluorescent lighting adapters is the fact that such adapters, like those of Morton and Broyer et al., do not qualify for rebates offered for fluorescent installations by some power companies, for example, Long Island Lighting Company. The reason for this is that the power company investigates the new or retrofitted installations for fluorescent lighting systems and grants such rebates if it is determined that the fluorescent systems are permanently installed. By contrast, the ease of removal and insertion of the self-contained fluorescent adapters of Morton and Broyer et al., asserted to be an advantage, also makes such adapters easily replaceable by incandescent lamps. Thus, the power companies cannot verify that installation of such fluorescent lighting systems is permanent, and therefore rebates are denied.

Another disadvantage of adapters such as those described in Morton or Broyer et al. is that because they are designed to be self-contained units complete with the required ballast transformers, they are bulky and have been found not to fit some commonly used lighting fixtures. Even if such adapters can be used, it is often necessary also to replace standard size lamp shades with larger lamp shades, thereby again reducing the incentive of purchasers and increasing their costs if they do purchase the adapters by virtue of the need to purchase different lamp shades as well.

Not only do the adapters sometimes not fit within standard sized shade supporting harps of fixtures, but they are also quite heavy because they contain one or more ballast transformers. As another disadvantageous result, if such adapters are placed on "armed" fixtures, such as swing arm fixtures, their excessive weight tends to tip the lamps over. This not only risks breakage of the adapters so as to increase replacement expenses, but also creates enhanced risk of fires and electrical shock resulting from the fixtures tipping over and breaking. And such adapters cannot practically be used in lighting fixtures of the counterbalanced arm type because the weight of the ballast transformers in the adapters would require a very heavy and expensive counterweight at the opposite end of the counterbalanced arm of the fixture.

Yet another disadvantage of self-contained adapters such as those described in Morton and in Broyer et al. is that because they are designed to be used in existing incandescent fixtures, the adapter case must be made dimensionally as small as possible. Because the ballast transformers are contained in the case as a single unit with the sockets and lamps, they are forced closely together. But doing so results in excessive heat production by the adjacent ballast transformers, with resulting increase of heat transfer from the transformers to other parts of the fluorescent lighting system, notably the light sockets and lamps.

Even when thermal barrier walls are provided to separate ballast transformers, those walls decrease the circulation of air in the case, even if ventilation openings are provided, which is directly contradictory to the intended benefit of such thermal barrier walls. This increases the risk of fire and also increases the risk that the ballast transformers will fail or be significantly reduced in terms of useful life. This, in turn, increases the overall cost to the user of adapter replacement, especially for high volume users such as hotels and industrial plants.

One of the goals of adapters, such at that disclosed in Broyer et at., is to provide two or three stages of illumination by selectively switching the power supply to different fluorescent lamps or to different combinations of lamps, thereby providing lighting similar to the well known three-way incandescent bulb. As desirable as that is in principle, the disadvantages of such adapters is compounded by efforts to provide such multiple stage lighting because the number of ballast transformers required increases with the increase in the number of stages of lighting for which the adapter is designed. As the adapters are self-contained with lamps, sockets, ballast transformers and screw-in bases, the three-way capability is offset by the increase in physical bulk, weight and required size of the adapter cases. The physical limitations on such self-contained adapters discourage the making of fluorescent lighting systems which have more than three levels of illumination. This is especially true in light fixtures having swing arms or cantilevered construction.

SUMMARY OF THE INVENTION

Accordingly, it is an object of the present invention to provide a fluorescent lighting system which is economical and easy to make, use and replace, the system being readily and economically installed and used, especially in high volume lighting situations such as hotels, motels, commercial and industrial settings.

It is another object of the present invention to provide such fluorescent lighting fixtures which, because of their structure, are resistant to theft, and which provide a structure that retains its most important, its heaviest, and its bulkiest structures intact even if the relatively low-cost, light weight and compact fluorescent lamps it uses are removed or broken.

It is another object of the present invention to provide fluorescent lighting fixtures which, because of their structure, enable the proper balancing of the fixture even when armed, cantilevered, or projecting lamp attachments are used, thereby helping to prevent the lighting fixtures from tipping over, with consequent breakage, shock hazard and fire hazard.

It is still another object of the present invention to provide a fluorescent light system which does not use self-contained adapters having a unitary structure which structurally encompasses lamps, sockets, ballasts transformers and related circuitry.

It is yet another object of the present invention to provide a fluorescent light system whose structure is compact and readily usable with standard size accessories such as lamp shades and the like.

An additional object of the present invention is to provide a fluorescent light system which provides light weight and compact structures for staged lighting, using two, three or more fluorescent lamps selectively energizable to yield different desired illumination outputs.

And another object of the present invention is to provide an improved fluorescent light fixture whose structure enables the separation of a plurality of ballast transformers sufficient to substantially reduce interactive heating therebetween, reduce heating of lamp sockets and related circuitry by the heat produced by the ballast transformers, and to reduce the size of the enclosure or enclosures supporting the ballast transformers.

Another object of the present invention is to provide a fluorescent lighting system which, by separation of its ballast transformers from their associated lamp sockets, enables the use of any number of fluorescent lamps in a light fixtures including as swing arm lights and cantilevered lights.

In order to meet these and other objects that will be evident from this disclosure to those skilled in this art, the present invention provides an improved fluorescent lighting fixture for selectively, independently or simultaneously powering at least one, and preferably a plurality of, fluorescent lamps, which preferably are of different power ratings.

In a preferred embodiment of this invention, a fluorescent lighting system includes two fluorescent lamp sockets, each of the sockets being adapted for receiving a fluorescent lamp having electrical contacts when the lamp is inserted into the socket, each of the fluorescent lamp sockets including electrical contacts for conveying electrical energy from a power supply connected to a fluorescent lamp via the lamp's electrical contacts when the lamps are inserted into the fluorescent lamp socket; a fluorescent lamp socket support case for supporting the fluorescent lamp sockets; at least one ballast transformer support case, each of the ballast support cases being adapted for mounting at least one ballast transformer, each of the ballast transformer support cases being separated from the fluorescent lamp support case; two ballast transformers, each of the ballast transformers being mounted in a selected one of the ballast transformer mounting cases, each one of the ballast transformers being electrically connected by electrical conductors to the electrical contacts of at least a selected one of the fluorescent lamp sockets for providing electrical energy to the fluorescent lamp connected, preferably removably, in the lamp socket, each of the ballast transformers being adapted for receiving electrical current via an electrical conductor from an electrical power supply; and a three way electrical switch electrically connected in series with the lamp sockets and with the power supply, the switch being adapted for disconnecting the power supply from the lamp sockets and adapted for selectively connecting the electrical power supply to one, to another, or to all of the fluorescent lamps via the lamp sockets when the lamps are connected to the lamp sockets. Thus, independent, selective and combined energization of the fluorescent lamps is enabled.

Preferably, the fluorescent lighting system of the present invention accommodates two or more fluorescent lamps, at least two of which, and preferably all of which, have different power ratings. For instance, one lamp has a 13 Watt rating, the other lamp has a 9 Watt rating. In this embodiment, a three-way switch electrically connected in series with the power supply and with each of the lamp sockets can be operated to convey electrical current from at least one of two ballast transformers so as to energize either the 13 Watt lamp or the 9 Watt lamp individually and independently, or to energize both the 13 Watt and 9 Watt lamps simultaneously. This configuration enables the fixture to provide three different levels of illumination, as is provided by three-way incandescent bulbs known in the art. The power ratings of the fluorescent lamps in terms of wattages shown in this disclosure are for illustration and are not to be taken as a limitation to the invention.

It is within the scope of this invention for any selected number of lamp sockets and fluorescent lamps to be used with corresponding ballast transformers in a fluorescent lighting system of this invention. The number of sockets and lamps shown in this disclosure is for illustration and not intended to be taken as a limitation of the invention. In fact, one of the advantages of this invention is that, because the case supporting the lamp sockets does not also support the ballast transformers and therefore greatly reduces the weight and bulk of the lamp socket support, the number of lamps that can be used in this invention is not limited by considerations of weight and size as in other devices, such as those disclosed in Broyer et al. Thus, the uses and designs of fluorescent light fixtures according to this invention are substantially expanded compared to those of other fluorescent lighting fixtures.

Different embodiments of this invention can have different numbers of fluorescent lamp sockets, different numbers of fluorescent lamp socket support cases, different numbers of ballast transformers, and different numbers of ballast transformer support cases, and different structural configurations, especially as to the placement in the fluorescent lighting system of the ballast transformers, and still all be within the scope of this invention.

However, one important characteristic shared by all such embodiments of this invention is that the fluorescent lamp socket support cases do not also support or contain ballast transformers. In fact, this invention teaches a spaced apart relationship of the case which support the fluorescent lamp sockets and the case which supports the ballast transformers. The ballast transformers in all of the embodiments of this invention, therefore do not contribute to the weight or bulk of the fluorescent lamp socket support cases and therefore enable the light fixture designer to reduce the size of the fluorescent lamp socket support case and/or increase the number of fluorescent lamp sockets and lamps in a given fixture without significantly increasing the weight or bulk of the device.

Also, the present invention enables the design of a cantilevered lighting system in which lamp receiving means includes at least one lamp socket adapted for receiving a fluorescent lamp therein, is placed at a first end of a weight connecting arm connecting it in a spaced apart relationship to a counterbalanced weight placed at a second end of the connecting arm, the connecting arm being pivotally connected to a lighting fixture standard which is connected at one end to a base adapted. In one preferred cantilevered embodiment of the present invention, the weight that counterbalances the lamp socket includes the ballast transformers electrically connected to the lamp sockets. In another cantilevered lighting system of the present invention, at least one of the ballast transformers connected to the lamp sockets is disposed in the base of the fluorescent lighting system.

This invention enables the ballast transformers to be placed at a location remote from the fluorescent lamp support case and lamp sockets. Because the ballast transformers are the heaviest part of the electrical structure of any fluorescent light fixture, the structure of this invention enables light fixture designers and installers to place the transformers where they contribute to the stability of the light fixture, as for example when they are placed in a lamp base so as to lower the center of gravity of the fixture becoming unstable and thereby reducing the possibility of the fixture tipping over.

The structures of the embodiments of this invention are particularly advantageous for "armed" types and for "downbridge" types of fluorescent light fixtures in which the fluorescent lamp socket support case, lamp sockets and lamps are extended from the body of the fixture, either permanently or retractably, in a cantilevered fashion. By placing the ballast transformers in a location remote from the fluorescent lamp socket support case, the extended end of the fixture is significantly lightened, making it more practical and safe. By contrast, if the lamp adapters such as those described in Morton or in Broyer et al were used, a much greater weight would be applied by the ballast transformers to the extended end of such armed or downbridge types of light fixtures. This, of course necessitates the use of stronger, more expensive materials and limits the amount of lamp extension that can be safely accomplished.

Another benefit of the structure of the present invention is the reduction in the possibility of theft of expensive parts of the light fixtures. Representatives of high volume lighting users, such as hotels and the like, have almost uniformly cited the high occurrence of theft of self-contained adapters and their high cost of replacement as primary reasons they reject the use adapters such as those disclosed in Morton and in Broyer et al. The reason for this is that the adapters are designed to be self-contained and easily removable and operable without any other equipment in standard incandescent light fixtures. Thus, when such a unit is stolen, simply by unscrewing it from the socket, the thief has an entirely functional light replacement unit. And, because such units contain not only the fluorescent lamp, but also the lamp sockets and the ballast transformers associated with the lamp sockets, they are far more expensive to replace than incandescent lamps or lamps used in accordance with the present invention.

The present invention overcomes such objections and makes the use of fluorescent lighting with this invention much more safe, economical and resistant to theft. Because this invention is not an adapter, but is a light fixture whose only easily removable part is the fluorescent lamps themselves, a thief can only steal a very inexpensive part of the fixture (the fluorescent lamps). Moreover, because the lamp case does not contain ballast transformers as in the Broyer et al type of adapters, when a thief steals a fluorescent lamp, he still needs a fluorescent light fixture in which to use it, because what he has stolen does not have ballast transformers as in the Morton and Broyer et al types of adapters. Because the expensive ballast transformers remain in the fixtures of the present invention, replacement of the stolen lamps is greatly less costly than replacement of adapters such as those of Morton or Broyer et al. The savings makes the use of fluorescent fixtures of the present invention much more attractive, especially to high volume lighting users such as hotels and the like.

Even without the need to replace stolen parts, in normal usage fluorescent lamps eventually fail, although their lifespan is very much greater than typical incandescent lamps. Thus, normal wear and tear and use will require periodic replacement. If the self-contained adapters with their transformers, as in Broyer et al. or as in Morton, are used and if the entire unit must be replaced, the replacement expense is much greater even absent theft, compared to the simple and inexpensive replacement of fluorescent lamps without ballast transformers, as in the present invention.

Although a fluorescent light fixture according to the present invention can be energized simply by plugging into an electrical outlet, the provision of a switch is advantageous for reasons clearly evident from the prior art. A simple on-off switch can be used, or a multi-way switch, such as a three-way switch, can be used to provide selective individual, group or simultaneous energization of lamps used in the invention.

The present invention also enables the use of fluorescent lighting in situations other than residential or hotel type settings. For example, one embodiment of the present invention provides a substantially flexible connector between the ballast transformer support case and the fluorescent lamp support case. For example, the connector can be simply an electrical cord which also provides for transmission of electricity from the ballast transformers to the lamp sockets while also providing a physical connection between the ballast transformer case and the remote fluorescent lamp support case. Other flexible types of connectors can be used also. Such an embodiment can be very useful for lighting deep holes or mine shafts or lighting inter-wall spaces in construction where the size and weight of the lamp to be lowered is very restricted. It can be advantageous to use fluorescent lighting in such situations, but the adapters of Morton or Broyer et al could be too heavy and too bulky for such uses because their lamp cases also enclose their ballast transformers.

BRIEF DESCRIPTION OF THE DRAWINGS

The objects and advantages of the present invention, as well as other embodiments and features of the present invention, will be more fully understood by reference to the following drawings, in conjunction with the detailed description of preferred embodiments of this invention.

DETAILED DESCRIPTION OF THE PREFERRED EMBODIMENT

Figure 1:
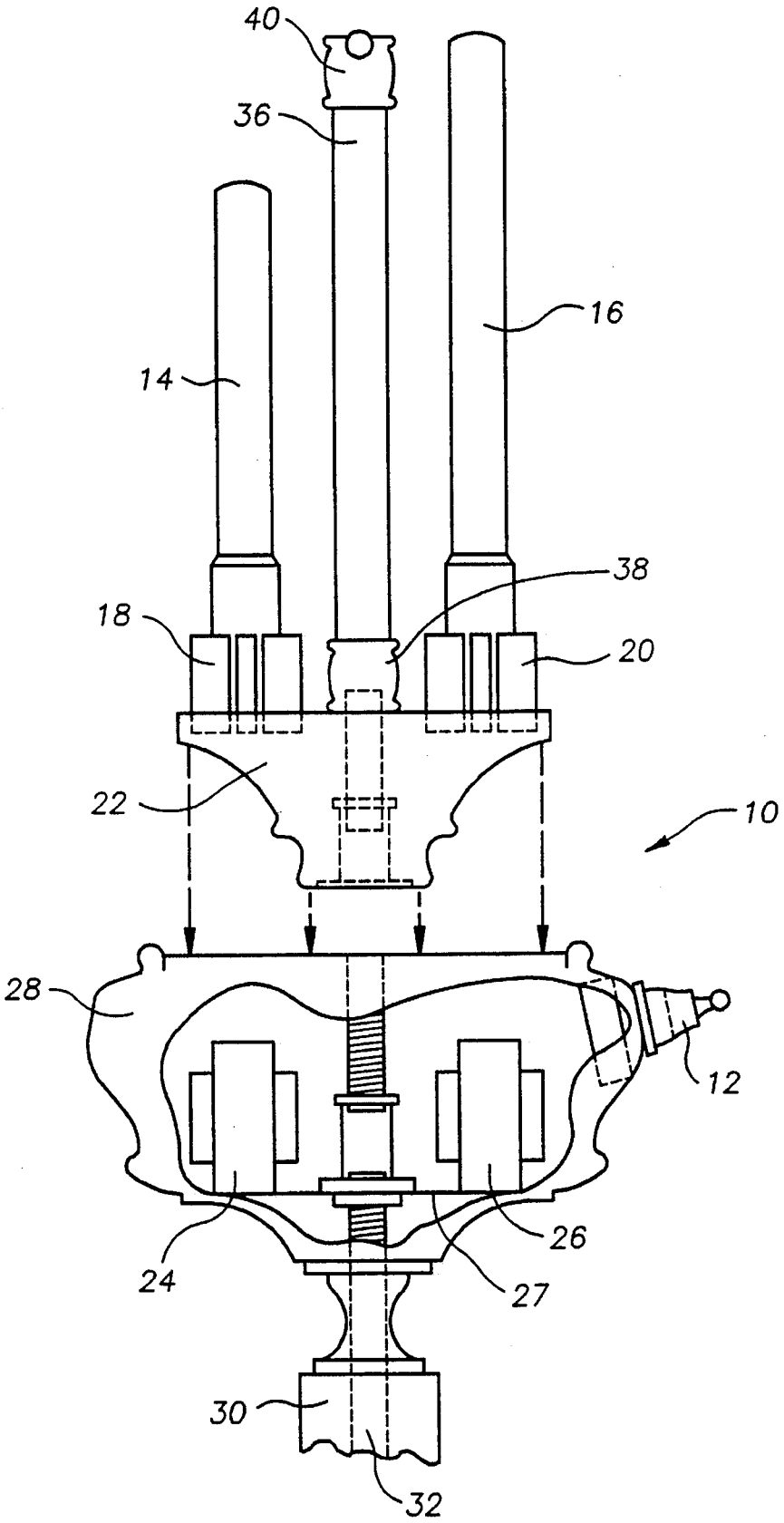
FIG. 1 is a partially cutaway side view of a preferred embodiment of the present invention adapted for use in a floor or table light fixture and using two fluorescent lamps controlled by a three-way switch.

The structure of the present invention, which includes separate or independent support cases for fluorescent lamp sockets and for at least one ballast transformer, enables the invention to be used to advantage in many different types of lighting fixtures. For example, this invention is adapted for use in light fixtures which include satellite modules, table lamp fixtures, floor lamp fixtures, downbridge type light fixtures, swing arm type light fixtures, cantilevered light fixtures, and is adapted for use in lighting for less common applications such as the lighting of wells, mine shafts, inter-wall construction and the like. Other applications and modifications of the embodiments described herein will be apparent to those with skill in the art and the following detailed description is intended to illustrate some of the embodiments within the scope of the invention and is not intended as a limitation of embodiments which are still within the scope of this invention.

As shown in the figures appended hereto, the fluorescent lighting system for supplying electrical energy to at least one fluorescent lamp according to the present invention comprises: lamp receiving means for supporting at least one fluorescent lamp connected thereto; ballast transformer means electrically connected to the lamp receiving means for conveying electrical current from an electrical power supply connected to the ballast transformer means to at least one of the fluorescent lamps when the fluorescent lamps are connected to the lamp receiving means; ballast support means for supporting the ballast transformer means; ballast support connecting means for connecting the ballast support means to the lamp receiving means; the ballast support connecting means being disposed intermediate the ballast transformer support means and the lamp receiving means and electrical power supply connecting means for fixedly electrically connecting the ballast transformer means to the electrical power supply.

Preferably, the lamp receiving means includes at least one lamp socket support case and at least one fluorescent lamp socket attached to the lamp socket support case, each of the fluorescent lamp sockets being adapted for conveying electrical current from at least one of the ballast transformer means to one of the fluorescent lamps when the fluorescent lamp is connected to the fluorescent lamp socket. Preferably also, the ballast transformer means includes at least one ballast transformer adapted for electrically connecting at least one of the fluorescent lamp sockets to the power supply connecting means. Ballast support connecting means preferably maintains the ballast support means in substantially spaced apart relationship to the lamp receiving means, and preferably the spaced apart relationship is sufficient to substantially reduce heat transfer from the ballast transformer means and the lamp receiving means. Preferably the fluorescent lighting system of the present invention also includes a switch electrically connected in series with the electrical power supply and with the lamp receiving means, the switch being adapted for disconnecting the electrical power supply from the lamp receiving means and being adapted for selectively electrically connecting the electrical power supply to at least one of the fluorescent lamps when the fluorescent lamps are connected to the fluorescent lamp socket. Preferably, the switch includes a multi-way switch and each one of the fluorescent lamps has a power rating different from the power rating of at least one other fluorescent lamp of the fluorescent lighting system of the present invention.

FIG. 1 shows an embodiment of a fluorescent lighting system 10 of the present invention for providing electrical energy to at least one of a plurality of fluorescent lamps, in which the invention is adapted for use in a floor light fixture or in a table light fixture. This embodiment illustrates a fluorescent lighting system 10 of the present invention which provides selective energization, by activation via a three-way switch 12, of one, the other, or both, of a first fluorescent lamp 14 preferably rated at 9 Watts and a second fluorescent lamp 16 preferably rated at 13 Watts, so as to enable fluorescent lighting system 10 to provide three stages of illumination intensities. As will be clear to those of skill in this art, switch 12 alternatively can be of other appropriate configurations, such as a one-way, two-way, multi-way, or other type switch determined by selected number of fluorescent lamps in the fluorescent lighting system, and such configurations will still be within the scope of this invention. Although this embodiment illustrates the use of 9 Watt and 13 Watt fluorescent lamps, it will also be apparent to those of skill in this art that the use of other power rated lamps is within the scope of this invention, as is the use of other numbers of lamps.

In this embodiment of the present invention, first fluorescent lamp 14 and second fluorescent lamp 16 are inserted into lamp receiving means which includes fluorescent lamp sockets 18 and 20 which are attached to and supported by fluorescent lamp socket support case 22. Fluorescent lamps 14 and 16, when inserted into fluorescent lamp sockets 18 and 20, respectively, make electrical contact with a power supply. Preferably, fluorescent lamp socket support case 22 is hollow, so as to enable electrical connection of fluorescent lamp sockets 18 and 20 to a power supply by electrical conductors (with circuitry well known in the art and not illustrated in FIG. 1 for the sake of clarity), so as to enable energization of fluorescent lamps 14 and 16. Fluorescent lamp socket support means 22 can be of a design which not only performs the desired support function, but which also enhances the aesthetic appearance of fluorescent lighting system 10.

This embodiment also provides a 9 Watt ballast transformer 24 and a 13 Watt ballast transformer 26 which are supported and substantially enclosed by ballast transformer support means, such as that illustrated by ballast transformer support case 28, which is of a configuration, preferably hollow, which enables ballast transformers 24 and 26 to be supported on ballast transformer support plate 27 which is contained in ballast transformer support case 28.

Ballast transformer support case 28 can be of other constructions, including constructions which have ventilation apertures of suitable configuration to enhance the dissipation of heat that might be generated by ballast transformers 24 and 26 during energization. Such construction of ballast transformer support case 28 can also include thermal barriers (not shown) placed in relation to ballast transformers 24 and 26 so as to enhance thermal isolation therebetween. It is within the scope of this invention also, as will be shown in relation to other embodiments of this invention, to provide separate ballast transformer support cases 28 for each one of ballast transformers 24 and 26 (and for additional ballast transformers if used within the scope of this invention).

In this embodiment, ballast transformer support case 28 is mounted on light standard 30, which preferably includes light standard conduit 32 therewithin so as to provide an internal route for electrical connection, as with electrical conductors known in the art, between a power supply and ballast transformers 24 and 26. Light standard 30 is of the type that can be used to advantage in a floor lamp fixture or in a table light fixture, the lower end of light standard 30 preferably being attached to a base (not shown) for placement on a floor or desk or the like, according to the design. The electrical connection, as by a standard two or three conductor cable, between ballast transformers 24 and 26 and a power supply, is enabled to be routed from ballast transformers 24 and 26 via light standard conduit 32 to an electrical plug for insertion into an electrical outlet or to a hard-wired connection to a power supply.

In this embodiment of the present invention, fluorescent lamp socket support case 22 is adapted for attachment to ballast transformer support case 28, as by screw attachment, or other means known in the art. FIG. 1 indicates how fluorescent lamp socket support case 22 can be attached to ballast transformer support case 28. Preferably, fluorescent lamp socket support case 22 is removably attachable to ballast transformer support case 28, so as to form a modular assemblage. Preferably, ballast transformer support case 28 is permanently attached, as by soldering, or other means known in the art, to light standard 30. As an added theft-reducing measure, of course, the base (not shown) attached to the bottom of light standard 30 can be permanently attached to a floor or table surface.

One of the advantages of the present invention is that fluorescent lamps 14 and 16 can be removed without removing socket support case 22 or ballast transformer case 28 from fluorescent lighting system 10. Thus, when fluorescent lamp 14 or 16 fail or are removed for any reason, they can be replaced quickly, easily and inexpensively, without replacing lamp sockets 14 or 16, without replacing lamp socket support case 22, without replacing ballast transformers 24 or 26, and without replacing ballast transformer case 28. This is in stark contrast to the adapters described by Morton or Broyer et al, which are specifically designed to require the entire adapter. With such adapters, replacement is quick and easy, but it necessitates replacement not only of fluorescent lamps, but also of the lamp sockets and ballast transformers, which are the most expensive parts of the fixture.

Fluorescent lamp sockets 18 and 20 are electrically connected to ballast transformers 24 and 26, by means well known in the art, such that inductive electrical current from the ballast transformers 24 and 26 is conveyed to energize fluorescent lamps 18 and 20 via the electrical contacts of fluorescent lamp sockets 18 and 20. Preferably, electrical connection between fluorescent lamp sockets 18 and 20, and an electrical power supply includes a three-way switch 12 to enable the user of fluorescent lighting system 10 to selectively energize one, the other or both of fluorescent lamps 14 and 16.

Figure 2:
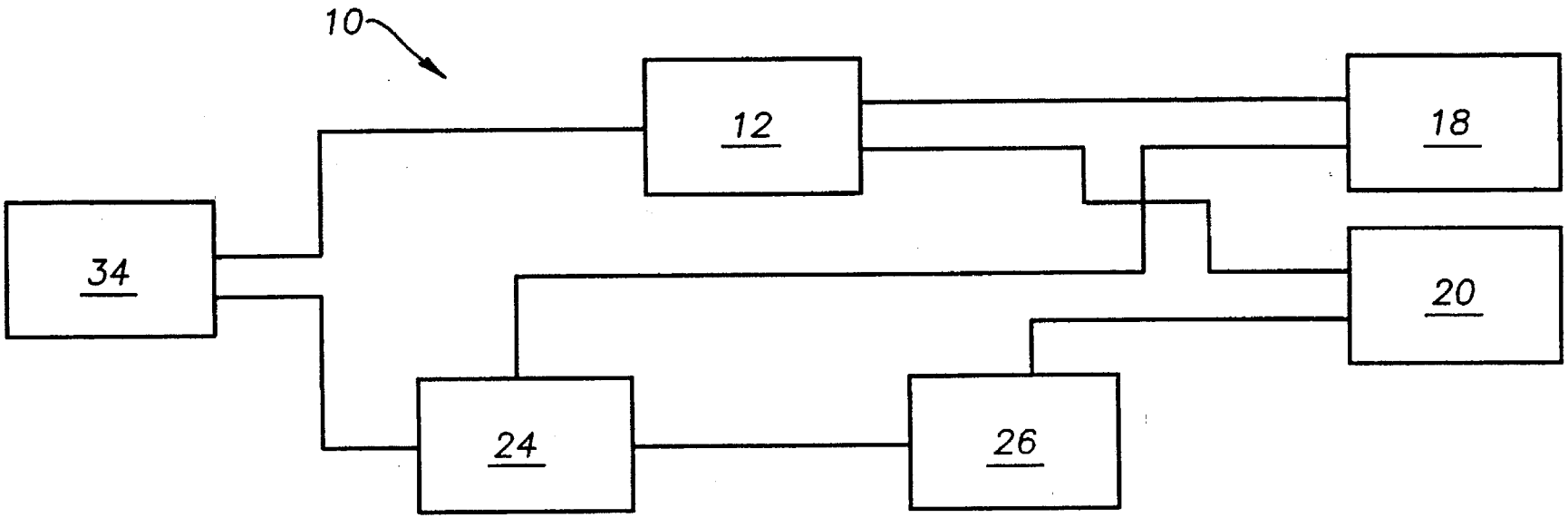
FIG. 2 is a block diagram showing the electrical connection of a three-way switch, two ballast transformers, two fluorescent lamps and a power supply.

FIG. 2 illustrates, in block diagram form, a preferred circuit for connection of electrical power supply 34 to fluorescent lamp sockets 18 and 20 via three-way switch 12 and ballast transformers 24 and 26. Three way switch 12 is connected in series with power supply 34 and fluorescent lamp sockets 18 and 20 such that three way switch 12 enables the selective direction of electrical current from power supply 34 to one, to the other, or to both of fluorescent lamp sockets 18 and 20 to provide three different levels of illumination of fluorescent lamps inserted into lamp sockets 18 and 20, and making electrical contact with the electrical contacts of fluorescent lamp sockets 18 and 20. Ballast transformer 24 is electrically connected in series with power supply 34 and fluorescent lamp socket 18, and is connected in series with power supply 24, ballast transformer 26 and fluorescent lamp socket 20. Ballast transformers 24 and 26 provide inductive current to lamp sockets 18 and 20 so as to energize one, the other or both of fluorescent lamps 14 and 16 inserted into fluorescent lamp sockets 18 and 20. Such electrical connections, and variations thereof within the scope of this invention, are well known in the art and will be understood from this disclosure by those of skill in the art.

Referring again to FIG. 1, this embodiment of the present invention preferably includes lamp shade support means for supporting at least one lamp shade, such as lamp shade support 36 attached at a first end 38 to fluorescent lamp socket support case 22 and adapted at a second end 40 for attachment, preferably removable attachment, of a lamp shade, not shown. Such means of attachment of lamp shade support 36 to fluorescent lamp socket support case 22, and such means of adapting second end 40 of lamp shade support 36 to enable attachment of a lamp shade, are well known in the art. Preferably, lamp shade support 36 is removably attached to lamp socket support case 22, so as to enable its removal for attachment to lamp socket support case 22 of a protective cover or light diffusing cover, not shown in FIG. 1, over fluorescent lamps 14 and 16 to protect them from breakage and/or to diffuse the light output of fluorescent lamps 14 and 16.

Figure 3:
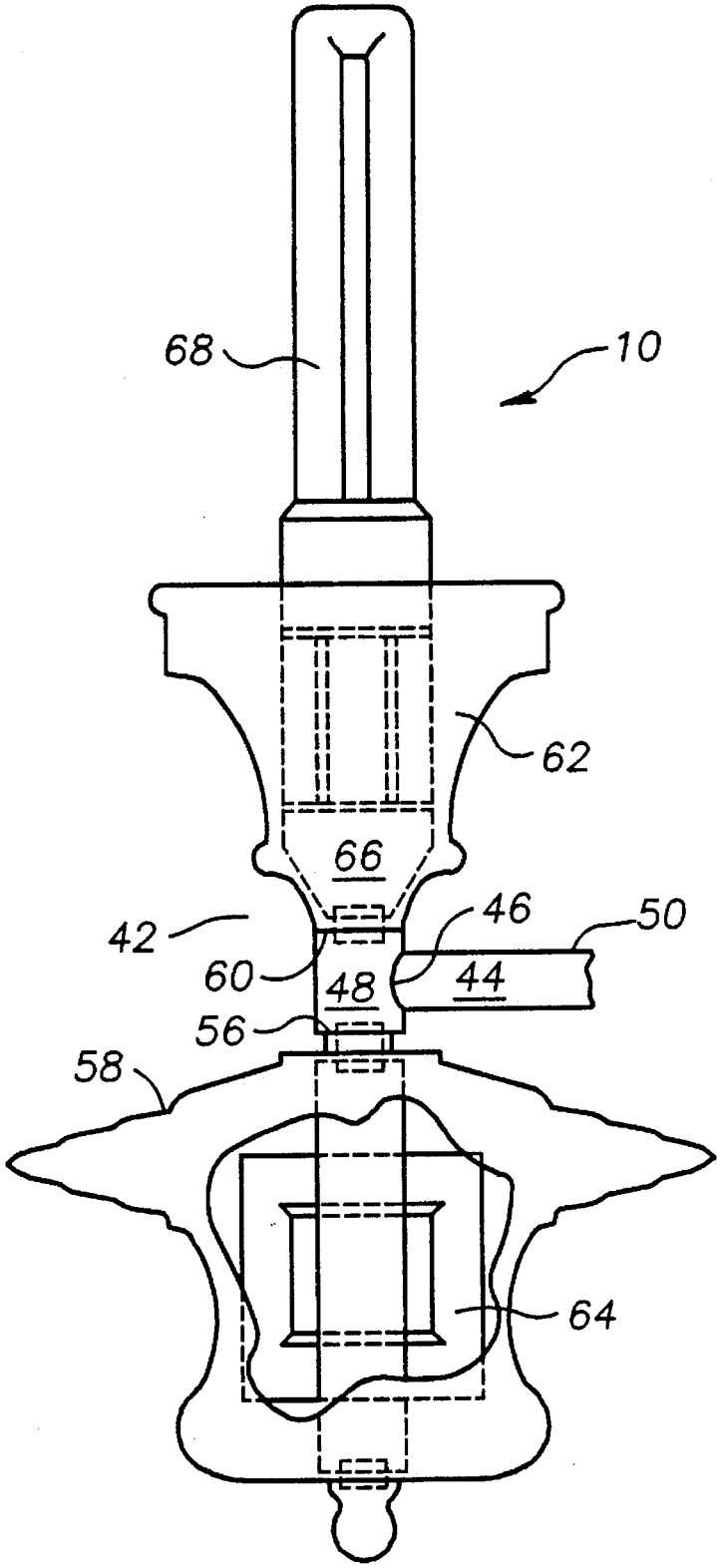
FIG. 3 is a partially cutaway side view of a preferred embodiment of the present invention adapted for use as a satellite module in a fluorescent light fixture.

FIG. 3 illustrates another embodiment of the present invention in which fluorescent lighting system 10 is adapted for use in a light fixture having at least one satellite lamp module 42. Such modules 42 include satellite connecting means, such as satellite connector 44 having a first end 46 attached to satellite module interconnecting means, such as satellite module interconnector 48, and a second end 50 connected to mounting means, not shown, for mounting satellite lamp module 42 to a mounting surface, such as a wall surface or a light standard such as light standard 30 shown in FIG. 1 or other functionally similar mounting means.

Satellite module interconnector 48 preferably is attached at a lower end 56 to ballast transformer support means such as ballast transformer case 58, and at an upper end 60 to fluorescent lamp support means such as fluorescent lamp support case 62, so as to interconnect cases 58 and 62. Ballast transformer support case 58 supports ballast transformer 64 therewithin, and fluorescent lamp support case 62 supports fluorescent lamp socket 66 which is attached, fixedly or removably, thereto. A fluorescent lamp 68, of desired power rating corresponding to the selected power rating of ballast transformer 64, is inserted into fluorescent lamp socket 66 so as to make electrical contact therewith. Electrical conductors (of circuitry not shown in FIG. 3 for clarity) electrically interconnect fluorescent lamp 68, fluorescent lamp socket 66, ballast transformer 64 and a power supply, not shown. Such electrical circuitry is well know in the art and is understood by those of skill in the art.

Preferably, satellite connector 44, satellite module interconnector 48, ballast transformer case 58 and fluorescent lamp socket support case 62 are hollow so as to enable the insertion therethrough of the electrical conductors, not shown. This embodiment also can include an on-off switch, not shown, connected in the electrical circuitry of fluorescent lighting system 10 in any fashion known in the art, the switch being either directly attached to fluorescent lighting system 10 or located at a remote location, such as a wall surface and the like.

Light fixtures which include at least one and sometimes a plurality of satellite lamps are well known in the art and can be found in wall mounted light fixtures, floor lamp fixtures, table lamp fixtures, and the like. Typically each such satellite light fixtures includes an individual lamp shade for each satellite lamp, although a single lamp shade can be disposed so as to cover all satellite lamps together. As disclosed in the above discussion relating to the embodiment shown in FIG. 1, a protective cover or light diffuser can be attached to fluorescent lamp support case 62 shown in FIG. 3 so as to cover fluorescent lamp 68, if desired.

Figure 4:
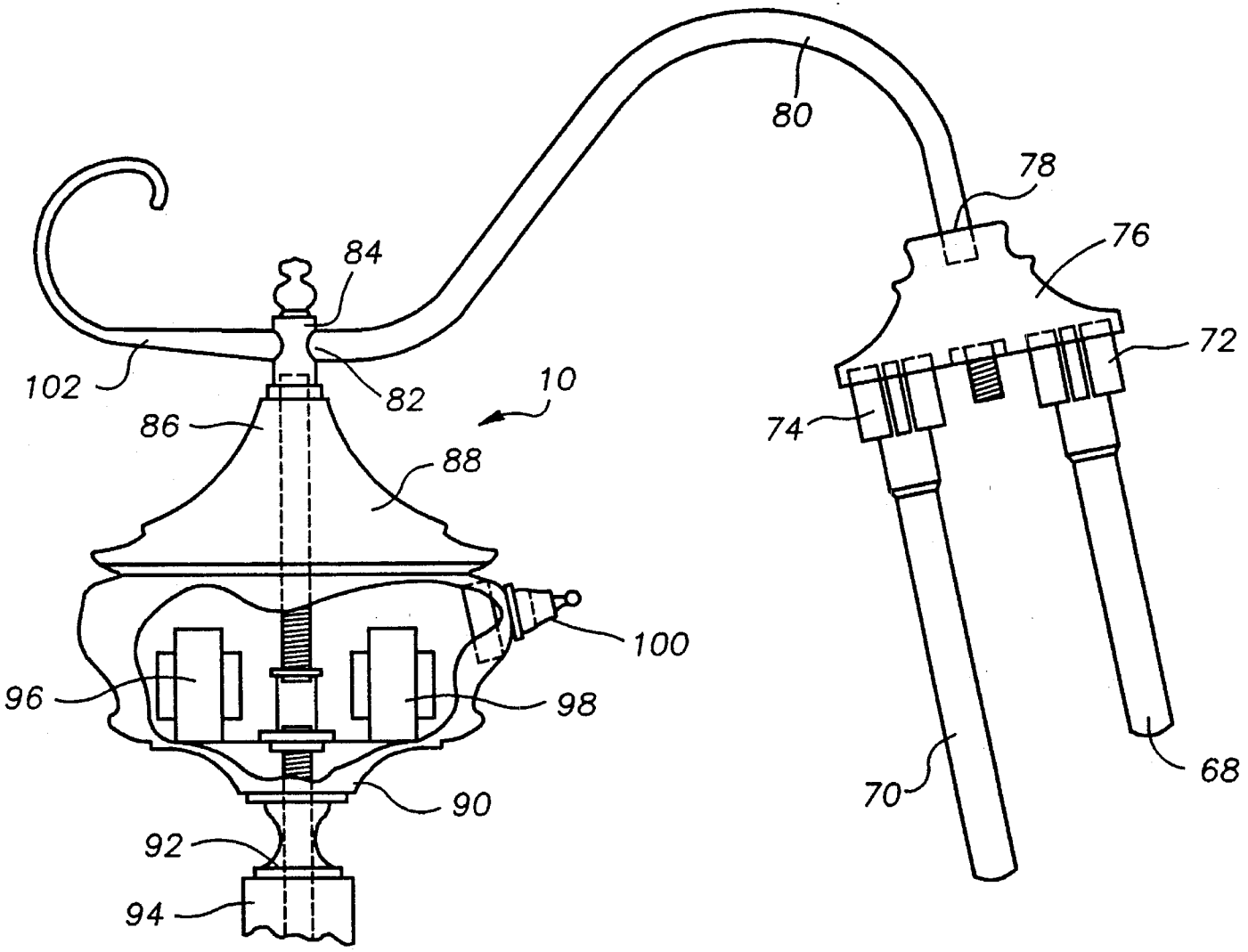
FIG. 4 is a partially cutaway side view of a preferred embodiment of the present invention adapted for use in a downbridge light fixture.

FIG. 4 shows a preferred embodiment of the present invention in which fluorescent lighting system 10 is adapted for use in a downbridge type light fixture. In this embodiment, a fluorescent lamp 68 rated at 9 Watts and a fluorescent lamp 70 rated at 13 Watts, are inserted into fluorescent lamp sockets 72 and 74, respectively, to make electrical contact therewith. Fluorescent lamp sockets 72 and 74 are attached to fluorescent lamp socket support means for supporting lamp sockets 72 and 74, such as fluorescent lamp socket support case 76.

Fluorescent lamp socket support case 76 is attached to a first end 78 of a downbridge arm 80, downbridge arm 80 having a second end 82 attached to downbridge arm connecting means such as downbridge arm connector 84. Downbridge arm connector 84 is attached to a top end 86 of ballast transformer support case 88, a bottom end 90 of ballast transformer support case 88 being attached to a first end 92 of light fixture support body 94, a second end (not shown) of which is adapted for connection to mounting means, not shown, such as a table lamp base, floor lamp base, or to a wall surface. Many such configurations are within the scope of this invention.

Ballast transformer support case 88 supports two ballast transformers 96 and 98 therewithin. Preferably, a three-way switch 100 is provided and is connected such that one, the other or both of fluorescent lamps 68 and 70 are energizable by selection of switch position. Preferably, fluorescent lamp socket support case 76, downbridge arm 80, downbridge arm connector 84, ballast transformer support case 88 and lighting fixture standard 94 are hollow so as to enable electrical wires to pass therethrough to connect a power supply with fluorescent lamps 68 and 70. Electrical conductors (including wires and contacts) interconnect a power supply with ballast transformers 96 and 98, three-way switch 100, and fluorescent lamp sockets 72 and 74, such that electrical current is provided to fluorescent lamps 68 and 70 as selected by operation of three-way switch 100. The configuration and connections of such electrical circuitry are well understood by those of skill in the art, and are exemplified by the block diagram shown in FIG. 2. It is also within the scope of this invention to provide other means for controlling the selective energization of fluorescent lamps 68 and 70, as by simply plugging in a power cord from the fixture to an electrical outlet, by providing a simple on-off switch, or providing remote switching capabilities, as by a wall switch and the like.

It is to be understood that various decorative elements, such as decorative arm segment 102 can be added to fluorescent lighting system 10, and various decorative font constructions of ballast transformer case 88 or fluorescent lamp socket support case 76 or downbridge arm 80 and other parts of the fixture can be designed within the scope of this invention.

As can be seen in FIG. 4, this invention provides a significant advantage of separating fluorescent lamp socket case 76 from ballast transformers 96 and 98 in ballast transformer support case 88, thereby substantially reducing the weight which downbridge arm 80 must bear. Thus, lighter and cheaper materials can be used for downbridge arm 80 and the associated parts. Additionally, the placement of the heavy ballast transformers in a position as shown in FIG. 4, rather than adjacent fluorescent lamp socket support case 76 at first end 78 of downbridge arm 80, makes such downbridge fixtures much safer to use in freestanding fixtures such as table light fixtures and floor light fixtures. It is clear that the center of gravity of fluorescent lighting system 10 shown in FIG. 4 is disposed almost directly over the longitudinal axis of lighting fixture standard 94, thereby increasing stability.

The embodiment of this invention shown in FIG. 4 also provides the benefit of reducing theft and reducing replacement costs, as are common benefits to all embodiments of this invention. The use of self-contained adapters such as those described by Morton and Broyer et al, would not be able to provide these and other benefits for downbridge or other types of light fixture.

Figure 5:
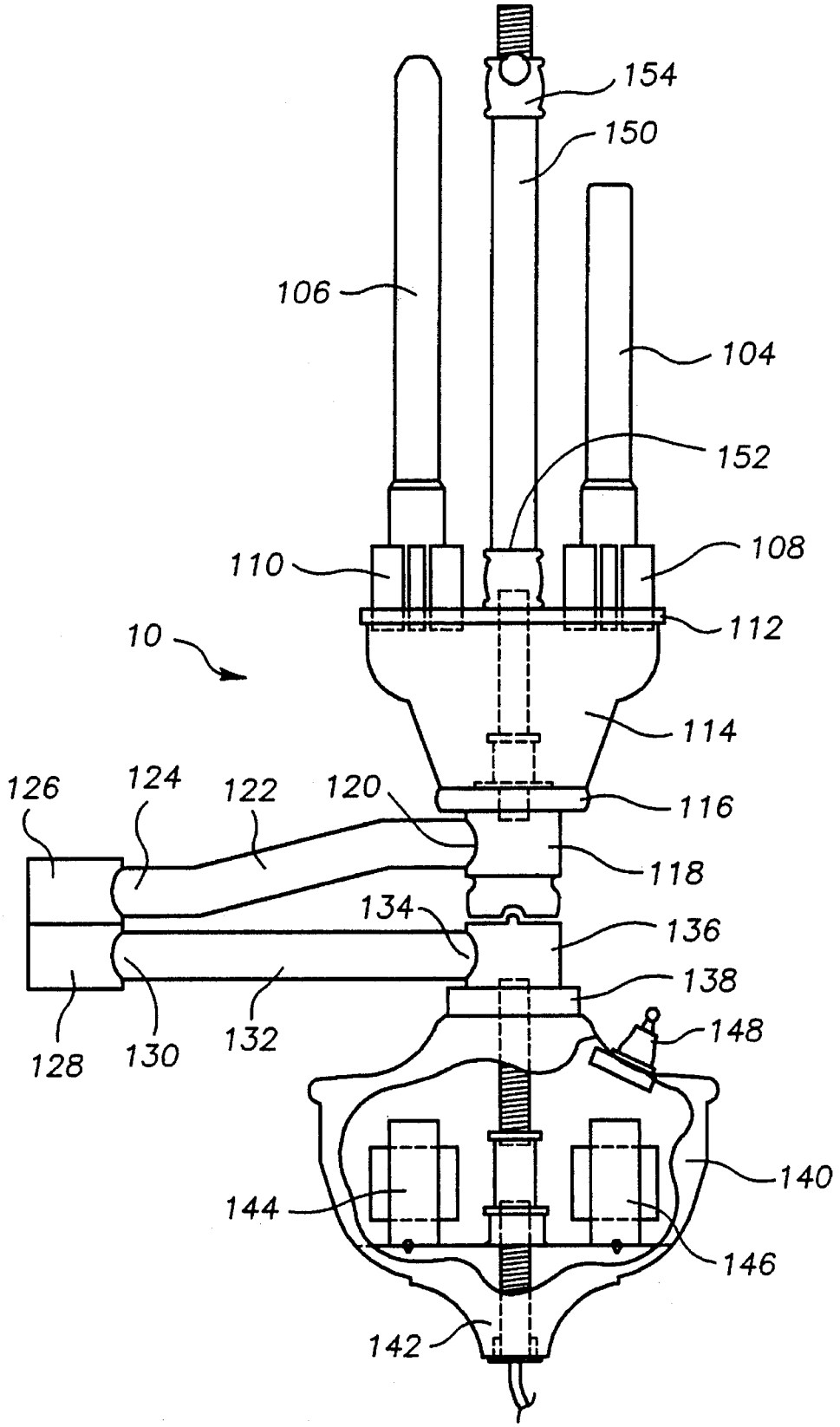
FIG. 5 is a partially cutaway side view of a preferred embodiment of the present invention adapted for use in a swing arm light fixture.

FIG. 5 shows an embodiment of the present invention in which fluorescent lighting system 10 is adapted for use in a swing arm type of light fixture. This type of light fixture includes means for extending or retracting the end of the fixture bearing the fluorescent lamps and can be used in various configurations, such as table light fixtures, floor light fixtures, wall mounted light fixtures, etc., as is understood by those of skill in the art.

In this embodiment, fluorescent lamp 104, preferably rated at 9 Watts, and fluorescent lamp 106, preferably rated at 13 Watts, are inserted into fluorescent lamp sockets 108 and 110, respectively, which are attached to an upper end 112 of fluorescent lamp socket support case 114. A lower end 116 of fluorescent lamp socket support case 114 is connected to lamp socket connector 118, which is also connected to a first end 120 of first lamp arm 122. A second end 124 of first lamp arm 122 is connected to a first lamp arm pivot connector 126, which is pivotally connected to second lamp arm pivot connector 128, by journalling or other means known in the art, so as to be horizontally rotatable about a vertical axis passing through first lamp arm pivot connector 126 and second lamp arm pivot connector 128. Second lamp arm pivot connector 128 is connected also to a first end 130 of second lamp arm 132, and second end 134 of second lamp arm 132 is connected to ballast transformer case connector 136.

The pivotal connection between first lamp arm pivot connector 126 and second lamp arm pivot connector 128 enables fluorescent lamp socket case 114 and its attached elements to be moved from a first position wherein it is disposed substantially directly above ballast transformer support case 130, as shown in FIG. 5, to a second position wherein fluorescent lamp socket case 114 is disposed outwardly from the vertical centerline of ballast transformer support case 130. This enables illumination from fluorescent lamps 104 and 106 to be moved so as to provide the lighting most desired by the user.

Ballast transformer case connector 136 is connected to a top end 138 of ballast transformer support case 140. A bottom end 142 of ballast transformer support case 140 preferably is attached to a light fixture standard or other support, not shown, for use as a floor light fixture, a table light fixture or wall fixture. The light fixture standard to be used will be apparent from the desired application to those of skill in the art.

Ballast transformer support case 140 supports 13 Watt ballast transformer 144 and 9 Watt ballast transformer 146 which are rated to supply appropriate inductive electrical energy to fluorescent lamps 106 and 104 respectively. Of course, if power ratings for fluorescent lamps 106 and 104 are different than those described in relation to FIG. 5, appropriate changes to the ratings of ballast transformers 144 and 146 would be clear to those of skill in the art. Preferably, a three-way switch 148 is also provided so as to enable the user of fluorescent lighting system 10 to selectively energize one, the other or both of fluorescent lamps 104 and 106. As described in relation to other embodiments of the present invention, the switch can be eliminated or a different kind of switch can be used within the scope of the present invention.

Electrical conductors, including contacts and wires, not shown in FIG. 5, interconnect a power supply with ballast transformers 144 and 146, three-way switch 148, fluorescent lamp sockets 108 and 110 and fluorescent lamps 104 and 106. Variations in the circuitry will be apparent to those skilled in the art, but a general block diagram of one such circuit is shown in FIG. 2. Preferably, ballast transformer support case 140, ballast transformer case connector 136, second lamp arm 132, second lamp arm pivot connector 128, first lamp arm pivot connector 126, first lamp arm 122, lamp socket connector 118 and fluorescent lamp socket support case 114 are hollow so as to enable the electrical connectors of the circuitry of this embodiment to be extended therethrough.

The swing arm light fixture shown in FIG. 5 also preferably includes a lamp shade support standard 150 for supporting a lamp shade, not shown. A first end 152 of lamp shade support standard 150 is connected to fluorescent lamp socket support case 114, either fixedly or removably, and a second end 154 of lamp shade support standard 150 is adapted for attachment thereto, preferably removably, of a lamp shade, not shown. As with the other embodiments of the present invention, a protective case or light diffusing case, not shown in FIG. 5, can be attached to fluorescent lamp socket support case 114 to protect fluorescent lamps 104 and 106 from breakage or to diffuse their light output.

As with other embodiments of this invention which include more than one fluorescent lamp, the lamps can be of power ratings selected by the system designer, and the number of fluorescent lamps can also be determined by the designer. The appropriate selection of corresponding power ratings for corresponding ballast transformers will be clearly understood to be necessary to those of skill in the art.

In the foregoing descriptions of preferred embodiments of the present invention, when more than one ballast transformer is used in a fluorescent lighting system 10, the ballast transformer means have been described as being supported or contained in a common ballast transformer support case. However, one advantage of the present invention over self-contained adapters and the like, such as those described in Morton and Broyer, is that the ballast transformers need not be supported by or contained in the same ballast transformer support case. This invention also enables the advantageous placement of each ballast transformer in an individual ballast transformer support case and the placement of clusters of ballast transformers in different ballast transformer support cases. One or more ballast transformers can be placed in any one of any number of ballast transformer support cases.

The advantages of such a capability provided by the present invention are important, not only from a design viewpoint, but from an engineering viewpoint. Such separation of multiple ballast transformers helps to prevent mutual heat conduction and overheating, as can result if all ballast transformers are placed in a single ballast transformer support case, even with ventilating apertures provided in the case. With multiple ballast transformer cases, the ballast transformers are held apart a selected distance so that heat generated therefrom is dissipated to the ambient environment more readily than possible with devices such as those of Morton or Broyer et al. Preferably, the distance by which the ballast transformers are held apart is sufficient to reduce or eliminate the heat transfer between the ballast transformers. The provision of the present invention for multiple ballast transformer support cases also enables the construction of smaller and lighter ballast transformer support cases.

The present invention also enables the ballast transformer cases and contents to be located in a place remote from the fluorescent lamp socket support case. For example, the ballast transformers and their cases can be place near the floor in the light support standard of a floor light fixture, thereby lowering the center of gravity of the fixture with consequent increase in stability. The provision of the present invention for multiple ballast transformer cases and wide variation in the possible placement of the cases can be used to increase the aesthetic appearance of fluorescent lighting systems of the present invention. For example, different configurations or designs of the several ballast transformer cases and different placement thereof can be used to improve the look of the fixtures.

Figure 6:
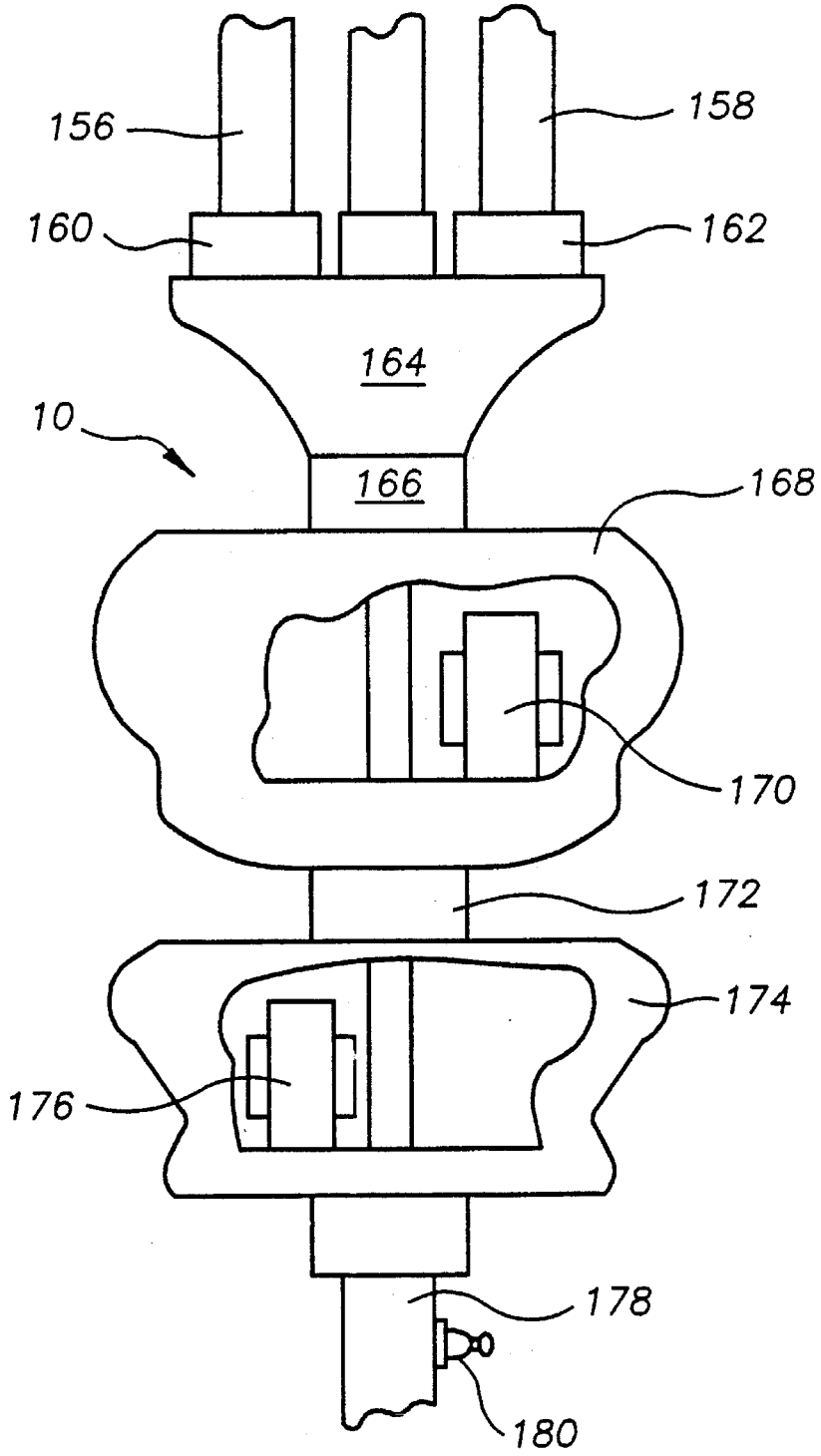
FIG. 6 is a partially cutaway general view of a light fixture according to the present invention having an individual ballast transformer support case for each of a plurality of ballast transformers

FIG. 6 shows an embodiment of a fluorescent lighting system 10 according to the present invention which is adapted for one of the foregoing configurations. In this embodiment, 13 Watt fluorescent lamp 156 and 9 Watt fluorescent lamp 158 are inserted into fluorescent lamp sockets 160 and 162, respectively, which are connected to fluorescent lamp socket support case 164. Fluorescent lamp socket support case 164 is connected via lamp socket connector 166 to first ballast transformer support case 168 which supports the 13 Watt first ballast transformer 170. First ballast transformer case 168 is further connected via ballast transformer case interconnecting means such as ballast transformer case interconnector 172 to second ballast transformer support case 174 which supports second ballast transformer 176. Second ballast transformer support case 174 is connected to light fixture support body 178 which preferably includes a substantially rigid tubular member connected at a first end to ballast support means and connected at a second end to mounting means for mounting the light fixture support body 178 on a surface. The light fixture support body 178 can be adapted for a floor light fixture, a table light fixture, a wall light fixture, and the like., with base or attachment means that will be apparent to those of skill in the art.

In FIG. 6, three-way switch 180 is shown attached to light fixture support standard 178, but can, within the scope of this invention and for any of the embodiments, be placed in other locations if desired by the lighting fixture designer or engineer. And, as noted before, ballast transformers 168 and 174 can be placed advantageously at locations more remotely from fluorescent lamp socket case 164 than shown, as for example, when placed near floor level in a floor light fixture to improve stability.

It will be clear to those of skill in the art that any number of fluorescent lamps, lamp sockets, ballast transformers and switches can be provided by the present invention, to suit the desired application and lighting requirements of the lighting designer.

Figure 7:
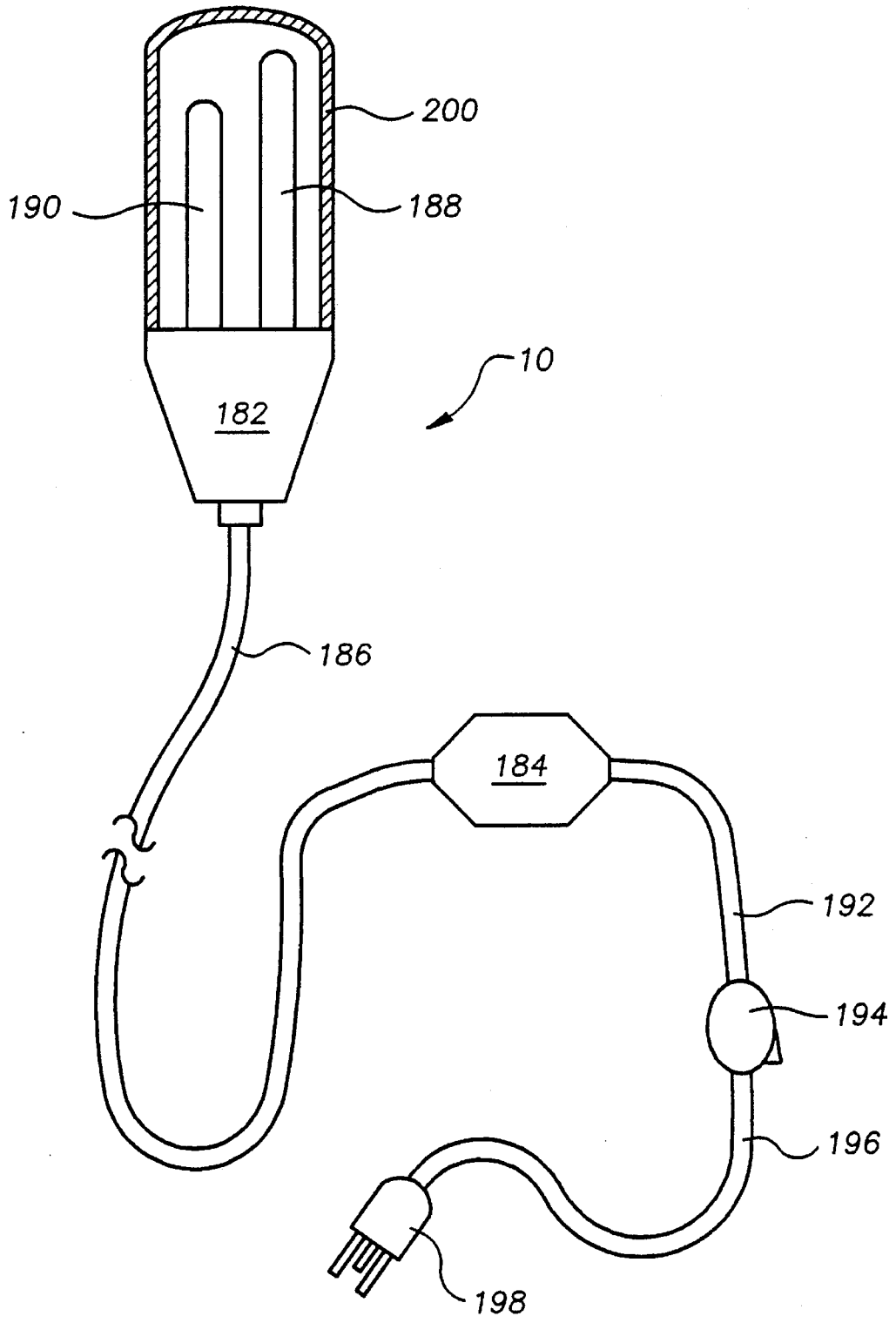
FIG. 7 is a partially cutaway, partially cross-sectioned general view of a preferred embodiment of the present invention showing a substantially flexible connector between a ballast transformer case and a remote fluorescent lamp support case.

FIG. 7 illustrates another embodiment of a lighting system 10 of the present invention which includes a substantial separation of a fluorescent lamp socket support case 182 from ballast transformer support case 184, wherein a light fixture support body includes a flexible or substantially flexible case interconnecting means such as case connector 186, which joins fluorescent lamp socket support case 182 remotely to ballast transformer support case 184. The 13 Watt fluorescent lamp 188 and 9 Watt fluorescent lamp 190 are inserted into fluorescent lamp sockets, not shown in FIG. 7, which are supported by fluorescent lamp socket support case 182. Two ballast transformers, 9 Watt and 13 Watt, not shown in FIG. 7, are contained in ballast transformer support case 184.

Electrical conductors from ballast transformers in ballast transformer support case 184 are contained in flexible switch connector 192 and connect to switch 194. Switch 194 is electrically connected to a power supply via electrical power supply connecting means which includes at least one electrical conductor disposed, for at least a portion of the length of the electrical power supply connecting means, within a substantially flexible tubular member of a light fixture support body such as flexible power cord 196 having a first end connected to ballast support means and a second end connected to an electrical plug 198. As in other embodiments of the present invention, hollow recesses or passages are provided in the appropriate components of fluorescent lighting system 10, through which the necessary electrical conductors are passed so as to enable energization of fluorescent lamps 188 and 190.

The embodiment of the present invention illustrated in FIG. 7 is particularly advantageous in enabling the lighting of small spaces or spaces to which access is difficult or dangerous. For example, lighting is often needed for wells, mine shafts, remote parts of buildings, and the like. And this embodiment is advantageous also in building construction or repairs where light is needed in, for example, the space in between dry wall sheets of partition walls. In these situations, the fluorescent lamps 188 and 190 and fluorescent lamp socket case 182 of the embodiment of the present invention shown in FIG. 7 can be lowered into such spaces by dangling them from case interconnector 186 which can be similar to a standard lighting cable. In such situations, it is also advantageous to provide protection for fluorescent lamps 188 and 190 by covering them. FIG. 7 shows, in cross section, a type of protective cover 200 which can be attached to fluorescent lamp socket case 182 to protectively cover fluorescent lamps 188 and 190. Protective cover 200 can be made of any suitable material which is sufficiently resistant to impact damage and which enables sufficient illumination by fluorescent lamps 188 and 190, of the space into which it is lowered. Preferably, protective cover 200 is attached to fluorescent lamp socket case 182 by means of locking screws and the like to provide security from tampering or theft.

Figure 8B:
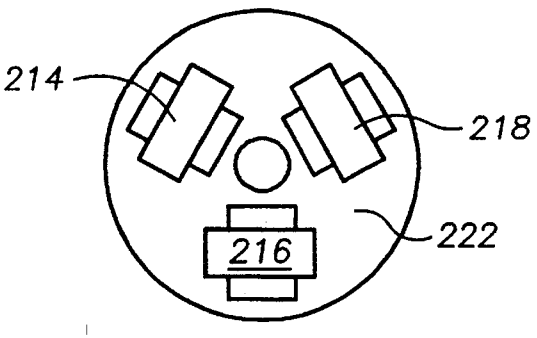
FIG. 8B is a plan view showing a preferred placement of the ballast transformers of the fluorescent lighting system shown in FIG. 8A.
Figure 8A:
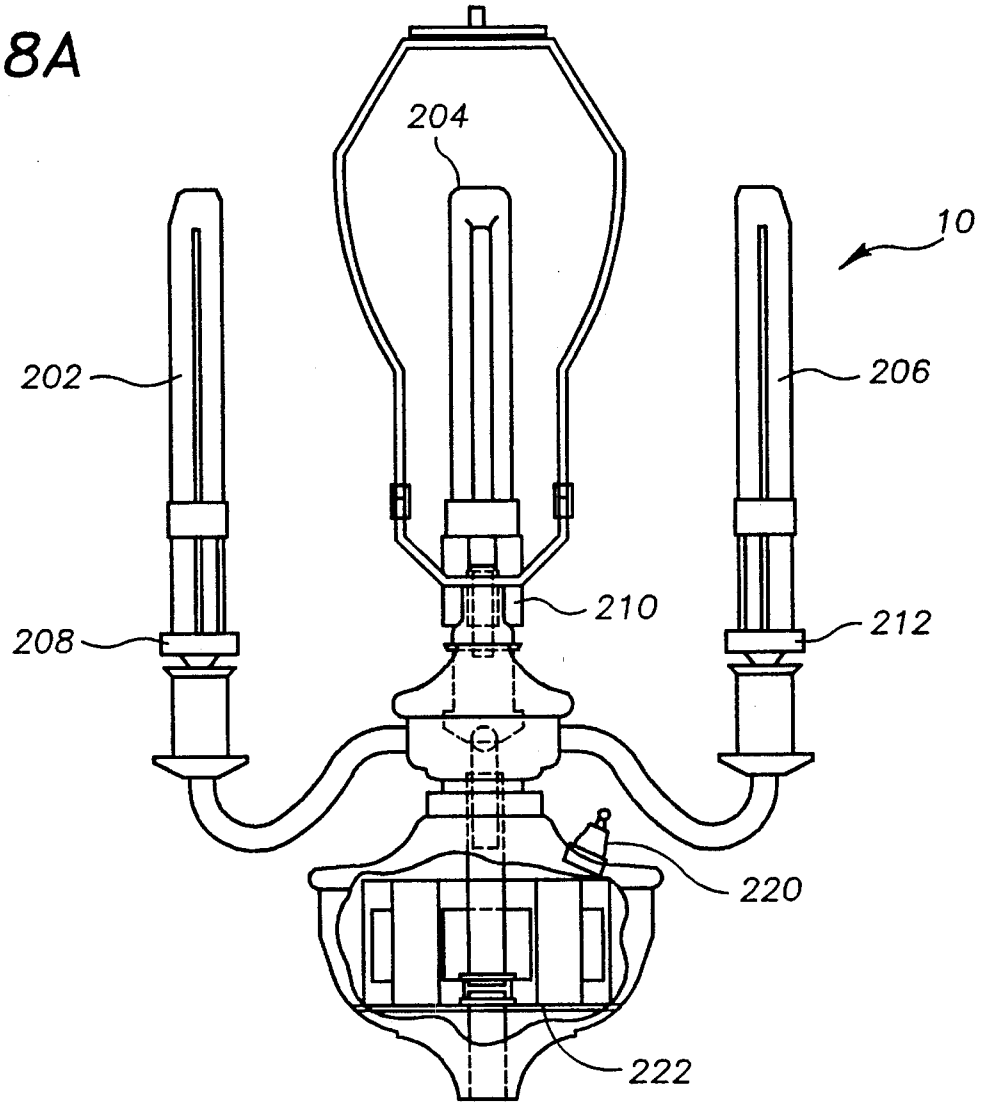
FIG. 8A is a partially cutaway view of a preferred embodiment of the present invention which includes three fluorescent lamps and three ballast transformers, with an associated multiway switch to enable selection of the desired lighting strength.

The basic structures, functions and advantages of the present invention, as set out in the foregoing discussion of several embodiments, are capable of expansion for use in other configurations. FIG. 8A, for example, shows a fluorescent lighting system 10 of the present invention in which three fluorescent lamps 202, 204 and 206 are inserted into three fluorescent lamp sockets 208, 210, 212, respectively, and are electrically connected, via circuitry known in the art, to associated ballast transformers 214, 216 and 218, shown in FIG. 8B supported by ballast transformer support plate 222, and electrically connected to a multi-way switch 220. The ballast transformers 214, 216 and 218 and switch 220 are electrically connected to a power supply according to circuitry known in the art, so as to enable selective energization of a selected one, two or three of fluorescent lamps 202, 204, and 206 by operation of switch 220. For example, in a first position, switch 220 causes energization of a selected one of bulbs 202, 204 or 206; in a second position, switch 220 causes energization of a selected two of bulbs 202, 204 or 206; in a third position, switch 220 causes energization of all three of bulbs 202, 204 and 206; and in a fourth position, switch 220 disconnects the power supply from all of bulbs 202, 204 and 206. This configuration is an example and is not intended to be a limitation, as many other switch and circuit configurations within the scope of the present invention will be apparent to those of skill in this art.

Figure 9:
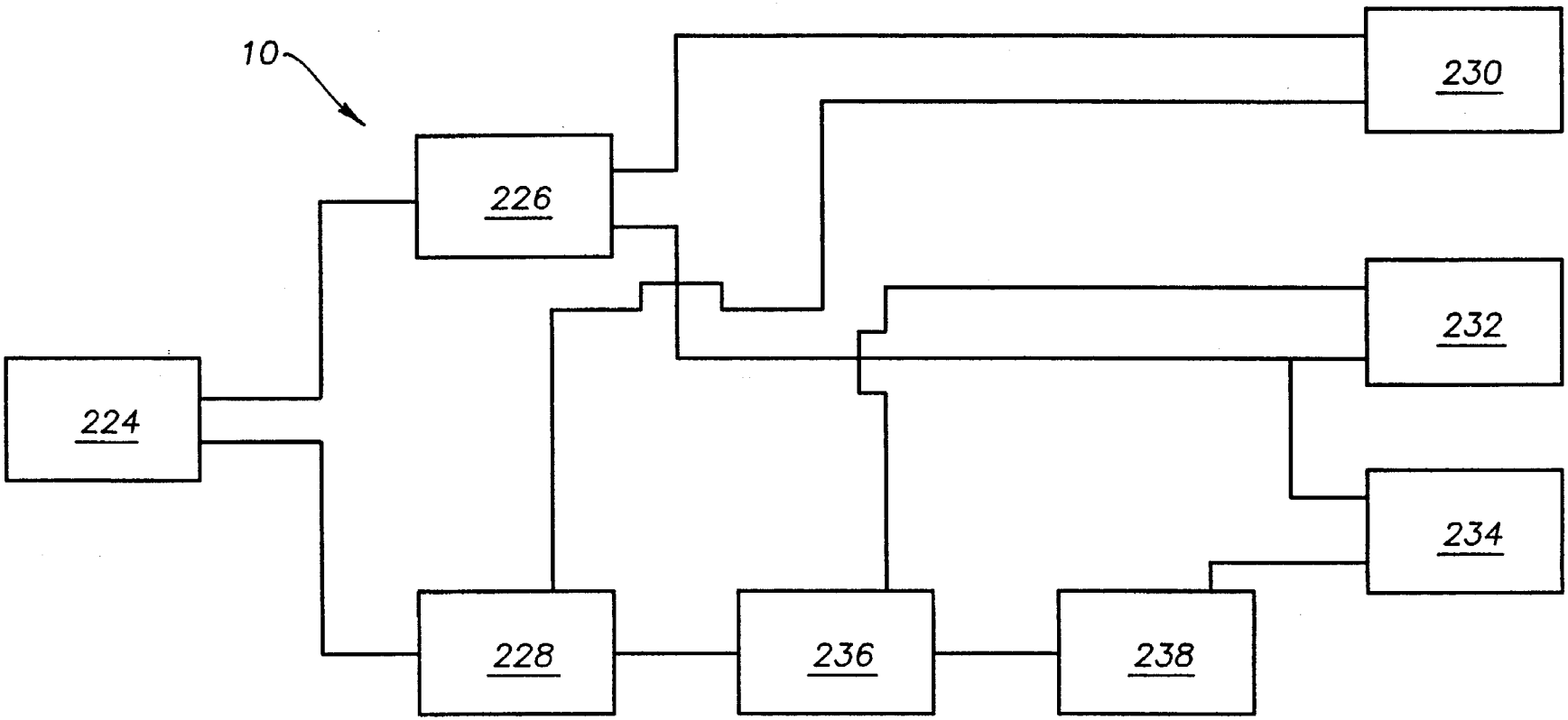
FIG. 9 is a block diagram showing the electrical connection of a multi-way switch, three ballast transformers and three fluorescent lamps, such as illustrated in FIG. 8A.

FIG. 9 illustrates one general electrical connection diagram for the embodiment of the present invention shown in FIG. 8A. A power supply 224 is connected to multi-way switch 226 and to a first contact of first ballast transformer 228. Multi-way switch 226 is connected to a first contact of first fluorescent lamp socket 230 and to a first contact of second fluorescent lamp socket 232 and to a first contact of third fluorescent lamp socket 234. First ballast transformer 228 is connected to a second contact of first fluorescent lamp socket 230 and to a first contact of second ballast transformer 236. A second contact of second ballast transformer 236 is connected to a second contact of second fluorescent lamp socket 232. A third contact of second ballast transformer 236 is connected to a first contact of third ballast transformer 238. A second contact of third ballast transformer 238 is connected to a second contact of third fluorescent lamp socket 234. This general electrical connection enables fluorescent lamp sockets 230, 232 and 234 to be energized individually, in various pairs, or all three simultaneously.

Figure 10:
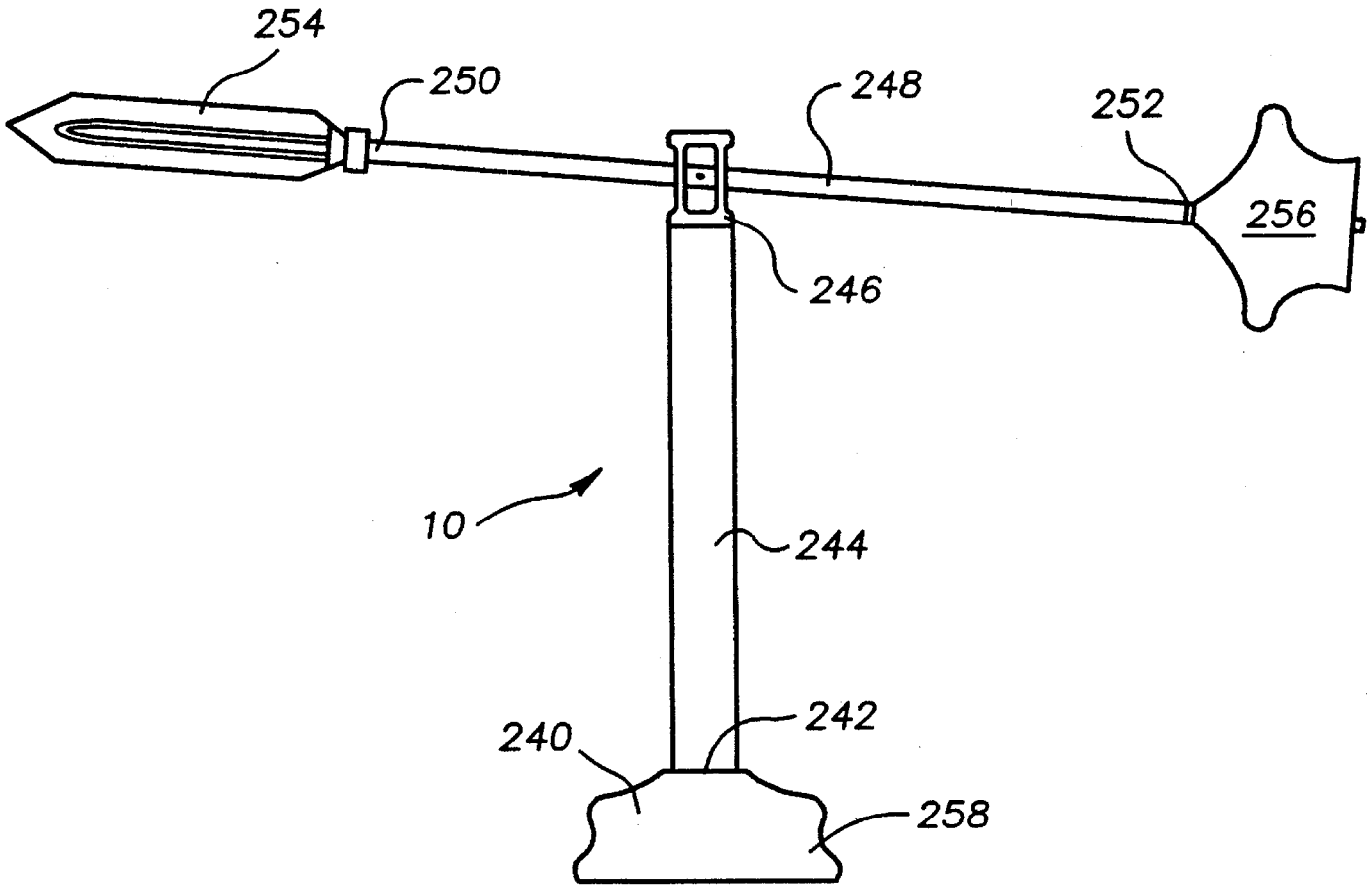
FIG. 10 is a side view of a preferred embodiment of the present invention which includes a cantilevered fluorescent lighting system.

FIG. 10 illustrates an embodiment of the fluorescent lighting system 10 of the present invention which includes a base 240 connected to a lower end 242 of a light standard 244. An upper end 246 of light standard 244 preferably is pivotally connected to a cantilevered light arm 248 having a first end 250 and a second end 252. First end 250 or cantilevered light arm 248 is attached to and supports a lighting module 254, which preferably includes lamp receiving means as described above in relation to other embodiments of the present invention. Second end 252 of cantilevered light arm 248 is attached to and supports a balance module 256. In this embodiment, lighting module 254 is movable about vertical and horizontal axes to provide the most desired placement of illumination. Base 240 preferably includes switch 258 of the type previously described, for selectively energizing fluorescent lamps in lighting module 254.

In the cantilevered light arm embodiment of the present invention shown in FIG. 10, placement of ballast transformers (not shown) can be made advantageously in various places. For example, one, some or all of the ballast transformers can be placed in base 258 so as to provide maximum lowering of the center of gravity of fluorescent lighting system 10. In this configuration, balance module 256 can be made of a relatively light weight material to counterbalance the small weight of lighting module 254. Alternatively, at least one ballast transformer can be placed within balance module 254. In this configuration, additional ballast transformers, if there are any to be associated with corresponding fluorescent lamp sockets in lighting module 254, can be placed in base 40. Other placements of the various elements of this embodiment will be understood by those of skill in this art.

It can be seen from the foregoing description that the present invention achieves the objects intended and provides for a fluorescent lighting system which is more versatile and safe than other systems. Although several preferred embodiments of the present invention have been described herein, it will be understood by those of skill in the art that many modifications, adaptations and variations of the embodiments described are also within the scope of the present invention. Thus, the invention is to be understood by reference to the appended claims.

I claim:

1. A fluorescent lighting system for supplying electrical energy to at least one fluorescent lamp, comprising:

lamp receiving means for supporting at least one fluorescent lamp connected thereto;

ballast transformer means electrically connected to said lamp receiving means for conveying electrical current from an electrical power supply connected to said ballast transformer means to at least one of said fluorescent lamps when said fluorescent lamps are connected to said lamp receiving means;

ballast transformer support means for supporting said ballast transformer means, said ballast transformer support means being adapted for fixed connection to a light fixture support body for maintaining said fluorescent lighting system in a selected position;

ballast transformer support connecting means for connecting said ballast support means to said lamp receiving means disposed intermediate said ballast transformer support means and said lamp receiving means, said ballast transformer support connecting means having a first end connected to said ballast support means and a second end connected to said lamp receiving means; and electrical power supply connecting means adapted for fixedly electrically connecting said ballast transformer means to said electrical power supply.

2. The fluorescent lighting system of claim 1, wherein:

said lamp receiving means supports a plurality of fluorescent lamps connected thereto.

3. The fluorescent lighting system of claim 1, wherein:

said lamp receiving means includes at least one lamp socket support case and at least one fluorescent lamp socket attached to said lamp socket support case, each of said fluorescent lamp sockets being adapted for conveying electrical current from at least one of said ballast transformer means to one of said fluorescent lamps when said fluorescent lamp is connected to said fluorescent lamp socket;

said ballast transformer means includes at least one ballast transformer adapted for electrically connecting at least one of said fluorescent lamp sockets to said electrical power supply connecting means; and said ballast transformer support means includes at least one ballast transformer support case for substantially enclosing at least one of said ballast transformers.

4. The fluorescent lighting system of claim 3, wherein:

said lamp receiving means includes a plurality of fluorescent lamp sockets attached to said lamp socket support case; and said ballast transformer means includes a plurality of ballast transformers.

5. The fluorescent lighting system of claim 1, wherein:

said ballast transformer support connecting means for connecting said ballast support means to said lamp receiving means maintains said ballast transformer support means in substantially spaced apart relationship to said lamp receiving means.

6. The fluorescent lighting system of claim 5, wherein:

said ballast transformer support connecting means maintains said ballast transformer support means sufficiently spaced apart from said lamp receiving means such that heat transfer from said ballast transformer means to said fluorescent lamp receiving means is substantially reduced.

7. The fluorescent lighting system of claim 3, wherein:

said ballast transformer support case substantially encloses at least two of said ballast transformers.

8. The fluorescent lighting system of claim 3, wherein:

said ballast transformer support means includes a separate ballast transformer support case for supporting each one of said ballast transformers, each of said ballast transformer support cases substantially enclosing one of said ballast transformers, said ballast transformer support cases being interconnected by ballast transformer case interconnecting means.

9. The fluorescent lighting system of claim 8, wherein:

said ballast transformer case interconnecting means maintains each one of said ballast transformer support cases in a spaced apart relationship to each other of said ballast transformer support cases.

10. The fluorescent lighting system of claim 9, wherein said spaced apart relationship is sufficient to enable substantial reduction in heat transfer between said ballast transformers in said ballast transformer support cases.

11. The fluorescent lighting system of claim 1, further including:

a switch electrically connected in series with said electrical power supply and with said fluorescent lamp receiving means, said switch being adapted for disconnecting said electrical power supply from said fluorescent lamp receiving means and being adapted for selectively electrically connecting said electrical power supply to at least a selected one of said fluorescent lamps when said fluorescent lamps are connected to said fluorescent lamp receiving means.

12. The fluorescent lighting system of claim 3, wherein:

said fluorescent lamp receiving means includes one fluorescent lamp socket support case and two fluorescent lamp sockets attached to said fluorescent lamp socket support case, each of said fluorescent lamp sockets being adapted for conveying electrical current from at least one of said ballast transformers to one of said fluorescent lamps when said fluorescent lamp is connected to said fluorescent lamp socket; and said fluorescent lighting system further includes:

a three way switch electrically connected in series with said electrical power supply and with each one of said fluorescent lamp sockets, said three way switch being adapted for disconnecting said electrical power supply from said fluorescent lamp sockets and being adapted for enabling selective application of electrical energy to a selected one, to the other and to both of said fluorescent lamp sockets.

13. The fluorescent lighting system of claim 12, wherein each one of said fluorescent lamps has a power rating different from the power rating of the other one of said fluorescent lamps.

14. The fluorescent lighting system of claim 1, further including:

a light fixture support body fixedly connected to said ballast transformer support means, said light fixture support body being adapted for maintaining said lighting system in a selected position and for supporting said electrical power supply connecting means and for protecting said electrical power supply connecting means from mechanical damage;

and wherein:

said electrical power supply connecting means is fixedly connected to said ballast transformer means.

15. The fluorescent lighting system of claim 14, wherein:

said light fixture support body connected to said ballast transformer support means includes a substantially rigid tubular member connected at a first end to said ballast support means and connected at a second end to mounting means for mounting said light fixture body on a surface; and said electrical power supply connecting means includes at least one electrical conductor connecting said ballast transformer means to said electrical power supply, said electrical power supply connecting means being disposed within said substantially rigid tubular member for at least a portion of the length of said electrical power supply connecting means.

16. The fluorescent lighting system of claim 14, wherein:

said light fixture support body includes a substantially flexible cable having one end fixedly connected to said ballast transformer support means; and said electrical power supply connecting means includes at least one electrical conductor fixedly connected to said ballast transformer means for connecting said ballast transformer means to said electrical power supply, said electrical power supply connecting means being disposed within said flexible cable.

17. The fluorescent lighting system of claim 5, wherein said ballast transformer support connecting means maintains said ballast transformer support means in substantially spaced apart relationship to said fluorescent lamp receiving means and said ballast transformer support means is disposed at a position sufficiently low in said fluorescent lighting system such that the center of gravity of said fluorescent lighting system is sufficiently low that the tendency of said fluorescent lighting system to become unstable is substantially reduced.

18. The fluorescent lighting system of claim 3, wherein:

said ballast transformer means includes three ballast transformers;

said fluorescent lamp receiving means includes one fluorescent lamp socket support case and three fluorescent lamp sockets, each of said lamp sockets being attached to said lamp socket support case, each of said fluorescent lamp sockets being adapted for conveying electrical current from at least one of said ballast transformers to one of said fluorescent lamps when said fluorescent lamp is connected to said fluorescent lamp socket; and said fluorescent lighting system further includes:

a switch electrically connected in series with said electrical power supply and electrically connected to each one of said fluorescent lamp sockets, said switch being adapted for disconnecting said power supply from said fluorescent lamp sockets and being adapted for selectively connecting said power supply to a selected one, two or three of said fluorescent lamp sockets, such that a plurality of levels of illumination are enabled to be provided by said fluorescent lighting system.

19. The fluorescent lighting system of claim 18, wherein:

each one of said fluorescent lamps connected to one of said fluorescent lamp sockets has a power rating different from the power rating of at least one other of said other fluorescent lamps connected to said fluorescent lamp sockets.

20. A fluorescent lighting system for supplying electrical energy to at least one fluorescent lamp, comprising:

a lamp socket support case;

at least one lamp socket attached to said lamp socket support case, each of said lamp sockets being adapted for conveying electrical current to a fluorescent lamp when said fluorescent lamp is connected to said fluorescent lamp socket;

at least one ballast transformer adapted for electrical connection to an electrical power supply, each of said ballast transformers being electrically connected to at least one of said lamp sockets;

at least one ballast transformer support case for supporting at least one of said ballast transformers;

case interconnecting means fixedly connected to said ballast transformer support cases and to said lamp socket support case, said case interconnecting means maintaining said ballast transformer support cases and said lamp socket support case in a substantially spaced apart relationship;

a lighting fixture standard having a first end and a second end, said first end being fixedly connected to said case interconnecting means;

a base connected to said second end of said lighting fixture standard; and electrical power supply connecting means for fixedly electrically connecting each of said ballast transformers to an electrical power supply.

21. The fluorescent lighting system of claim 20, wherein:

said fluorescent lighting system includes a plurality of lamp sockets attached to said lamp socket support case, and a plurality of ballast transformers adapted for electrical connection to an electrical power supply.

22. The fluorescent lighting system of claim 20, wherein:

said first end of said lighting fixture standard is pivotally connected to said case interconnecting means that said lamp socket support case is balanced by said ballast transformers supported by said ballast transformer support case.

23. A fluorescent lighting system for supplying electrical energy to a plurality of fluorescent lamps, comprising:

a lamp socket support case;

a plurality of fluorescent lamp sockets attached to said lamp socket support case, each of said lamp sockets being adapted for conveying electrical current to a fluorescent lamp when said fluorescent lamp is connected to said fluorescent lamp socket;

a plurality of ballast transformers adapted for electrically connecting said ballast transformers to an electrical power supply, each one of said ballast transformers being electrically connected to at least one of said lamp sockets;

a balance weight for balancing said lamp socket support case;

weight connecting means connected to said balance weight and to said lamp socket support case, said weight connecting means maintaining said balance weight and said lamp socket support case in a spaced apart relationship;

a lighting fixture standard having a first end and a second end, said first end being connected to said weight connecting means between said balance weight and said lamp socket support case;

a base connected to said second end of said lighting fixture standard, said base being adapted for containing and supporting said ballast transformers;

electrical power supply connecting means for electrically connecting each of said ballast transformers to an electrical power supply; and a switch electrically connected in series with said electrical power supply and connected to said lamp sockets, said switch being adapted for disconnecting said electrical power supply from said fluorescent lamp sockets and being adapted for selectively electrically connecting said power supply to at least a selected one of said fluorescent lamps when said fluorescent lamps are connected to said fluorescent lamp sockets.

24. The fluorescent lighting system of claim 23, wherein:

said first end of said lighting fixture standard is pivotally connected to said weight connecting means.

25. The fluorescent lighting system of claim 23, wherein:

at least one of said fluorescent lamps has a power rating different from the power rating of at least one other of said fluorescent lamps.

26. The fluorescent lighting system of claim 23, wherein:

said fluorescent lighting system includes three fluorescent lamp sockets attached to said lamp socket support case;

said fluorescent lighting system includes three ballast transformers; and said switch is a three way switch.

* * * * *